US006498495B1

(12) United States Patent
Bradenbaugh

(10) Patent No.: US 6,498,495 B1
(45) Date of Patent: Dec. 24, 2002

(54) METHOD AND APPARATUS FOR TESTING FUEL GAS CONTROL SYSTEMS FOR GAS FIRED APPLIANCES

(76) Inventor: Kenneth A. Bradenbaugh, 10078 Candlestick La., Concord, OH (US) 44077

( * ) Notice: Subject to any disclaimer, the term of this patent is extended or adjusted under 35 U.S.C. 154(b) by 0 days.

(21) Appl. No.: 09/648,603

(22) Filed: Aug. 26, 2000

Related U.S. Application Data

(60) Provisional application No. 60/150,904, filed on Aug. 26, 1999.

(51) Int. Cl.[7] ..... G01R 31/06; G01R 31/08; G01R 31/02; F23D 14/72

(52) U.S. Cl. ..... 324/546; 324/514; 324/73.1; 137/66

(58) Field of Search ..... 324/546, 555, 324/522, 514, 158.1, 73.1; 48/192; 137/66; 431/16

(56) References Cited

U.S. PATENT DOCUMENTS

| | | | | |
|---|---|---|---|---|
| 4,151,862 A | * | 5/1979 | Ueda et al. | 137/629 |
| 5,444,390 A | * | 8/1995 | Bartlett et al. | 324/770 |
| 6,123,093 A | * | 9/2000 | D'Antonio et al. | 137/78.3 |
| 6,234,189 B1 | * | 5/2001 | Koch | 137/66 |

* cited by examiner

*Primary Examiner*—N. Le
*Assistant Examiner*—Anjan K. Deb

(57) ABSTRACT

Disclosed herein are a methods for testing operability of a thermocouple device and operability of a safety valve solenoid and ECO fuse circuit all in a fuel gas control system for a gas fired appliance. Also disclose are apparatus for carrying out such methods, the apparatus comprising a test instrument, for applying selected millivolt DC currents to the safety valve solenoid and ECO fuse circuit and for measuring millivolt DC current output of the thermocouple device, and-an adaptor for connecting the test instrument to the safety valve solenoid and ECO fuse circuit of the fuel gas control system.

6 Claims, 3 Drawing Sheets

METHOD AND APPARATUS FOR TESTING FUEL GAS CONTROL SYSTEMS FOR GAS FIRED APPLIANCES

This application claims the benefit of provisional application No 60/150,904 filed on Aug. 26, 1999.

BACKGROUND OF THE INVENTION

1. Brief Description of the Invention

The present invention relates to methods and apparatus for testing and analyzing operability of fuel gas control systems for appliances such as water heaters, furnaces, cooking ranges and ovens, decorative fireplace inserts, pool heaters and similar gas fired appliances. More particularly, the present invention relates to methods and apparatus for testing operability of a thermocouple device of a fuel gas control system and for testing operability of a safety valve solenoid-high temperature electricity cut off fuse, (ECO fuse) circuit of a fuel gas control system under simulated load conditions.

2. Background of the Invention

Gas control systems for appliances are commercially available and widely used. A gas control system supplies fuel gas to an appliance under conditions such that the fuel gas may be safely ignited in the appliance firing chamber. In situations where safe ignition of the fuel gas cannot be ensured, the gas control system will prevent fuel gas from entering the appliance firing chamber. Such gas control systems are available for both natural gas and liquefied petroleum gas, (LPG), fuels.

Such gas control systems are well known and understood and only such description will be given here as is required to describe the method and apparatus of the present invention. An illustrated description of a typical gas control system may be found in "Service Manual For Residential Gas Water Heater Control", published in 1997 by White Rogers division of Emerson Electric Company.

A gas control system for an appliance comprises several elements acting cooperatively to achieve the functions of safely controlling flow of fuel gas to the appliance firing chamber and ensuring ignition of the fuel gas. Typically, a gas control system comprises a fuel gas control valve having a safety valve solenoid, an ECO fuse, a pilot flame device, an appliance burner and a heat sensing thermocouple device. The safety valve solenoid, ECO fuse and thermocouple device are connected in a series electrical circuit. In one type of gas control system, a pilot flame from the pilot flame device is maintained continuously for activating the thermocouple device and for igniting the fuel gas at the appliance burner. In another type of gas control system, fuel gas is ignited at the appliance burner by a spark gap igniter and the gas burner flame activates the thermocouple device. The ECO fuse senses temperature in the medium heated, (water, or air), in an appliance and the ECO fuse breaks upon sensing high temperature in the heated medium, for stopping flow of fuel gas to the appliance burner and the pilot flame device.

A gas control valve in a typical fuel gas control system comprises a solenoid activated safety valve and a manual shunt valve. The solenoid activated safety valve is opened, for flow of fuel gas through the gas control valve, upon the solenoid being activated by a millivolt DC current generated by the thermocouple device upon sensing a pilot flame at the pilot flame device in the appliance firing chamber. The manual shunt has three positions: "off", which prevents flow of fuel gas through the gas control valve; "pilot", which allows flow of fuel gas to the pilot device when the solenoid safety valve is open; and "on", which allows flow of fuel gas to the pilot device and the appliance burner when the solenoid safety valve is open. The gas control valve also comprises a manual override which, upon manual activation, opens the safety valve when the manual shunt is in "pilot" position, for allowing ignition of a pilot flame at the pilot flame device before the thermocouple device senses temperature sufficiently high to generate a millivolt DC current sufficient to activate the solenoid and open the safety valve.

The thermocouple device comprises a bimetallic thermocouple, a first electrical conductor connected to one leg of the bimetallic thermocouple, and a second electrical conductor connected to the other leg of the bimetallic thermocouple. The first electrical conductor is commonly a copper tube which runs from the first leg, of the thermocouple to the body of the gas control valve. The second electrical conductor is an electrically insulated wire which runs from the second leg of the thermocouple, through the copper tube, for electrical connection to the safety valve solenoid. The copper tube of the first electrical conductor: connects the first leg of the thermocouple to the body of the gas control valve; supports the second electrical conductor from the second leg of the thermocouple to the gas control valve for connection to the safety valve solenoid; and provides support for the thermocouple in the appliance firing chamber. A thermocouple, as used in gas control systems, generally has a DC out put voltage in the range of about 7 to 30 millivolts, depending on the bimetallic elements and the temperature to which the thermocouple is exposed. The thermocouple and safety valve solenoid are matched to ensure that the thermocouple will generate sufficient DC voltage to operate the solenoid under normal operating conditions.

The thermocouple, ECO fuse and safety valve solenoid are in a closed loop, series electrical array such that a millivolt DC current flows from the thermocouple second leg, through the second electrical conductor, through the ECO fuse into the input of the safety valve solenoid. From the safety valve solenoid output, the millivolt DC current flows through the body of the gas control valve, through the first electrical conductor to the thermocouple first leg, thus completing the closed loop electrical circuit.

The ECO fuse is a thermal fuse located in the medium being heated by the appliance. For example, in the water tank or the air outlet plenum of a water heater or an air heater. In the event the medium becomes overheated, the ECO fuse will melt and break the electrical connection between the thermocouple and the safety valve solenoid, thus shutting off fuel gas to the main burner and the pilot burner of the appliance.

3. Description of Pertinent Art

It is well known that appliance gas control systems often fail in operation. Such failures may be caused by a variety of causes, such as failure of the safety valve solenoid, failure, or melting, of the ECO fuse, or failure of the thermocouple. Often, the causes of such failures are difficult to determine. The gas control valve and ECO fuse are supplied as a unit and the thermocouple device is supplied as a separate unit. Neither unit is subject to repair and must be replaced when the unit fails. As each unit is relatively expensive, it is desirable to determine which unit has failed and to replace only the failed unit.

A thermocouple device may be easily checked by disconnecting it from the gas control valve and connecting the first and second electrical conductor to a millivolt meter. A pilot flame is then applied to the thermocouple and the DC voltage generated is registered by the millivoltmeter. In such a test, if the millivolt output from the thermocouple device is at least about 7 millivolts, the thermocouple device is considered operational. This test is referred as an "unloaded test" of the thermocouple device. This test of the thermocouple does not test the safety valve solenoid and ECO fuse portion of the fuel gas control system.

A second test method, employing a special adaptor and a millivolt meter, for testing the entire electrical circuit of a fuel gas control system, (safety valve solenoid, ECO fuse, thermocouple device), under loaded conditions is disclosed in "Service Manual For Residential Gas Water Heater Control", published 1997, White Rogers division of Emmerson Electric Company. For this method, the thermocouple device is disconnected from the gas control valve and a special adaptor is connected between the gas control valve and the thermocouple device. The special adaptor reconnects the thermocouple device, safety valve solenoid and ECO fuse and also allows a millivolt meter to be connected to both leads from the thermocouple. According to this method, after the adaptor is installed and the millivolt meter is connected to each of the thermocouple leads, the gas control valve is set to "pilot" position and the manual override of the safety valve is engaged. The pilot flame is then ignited and is allowed to heat the thermocouple for about 3 minutes. The millivolt meter is observed during this heating period. A 7 millivolt output from the thermocouple device should be sufficient to energize the safety valve solenoid and hold the safety valve open such that flow of gas to the pilot device will continue when the safety valve manual override is released. According to this method, if the thermocouple device output measured by the millivolt meter does not rise to at least 7 millivolts at the end of the 3 minute test period, (after ensuring that the pilot flame is properly directed onto the thermocouple), then the thermocouple device is judged faulty and should be replaced. On the other hand, if the thermocouple output rises to at least 7 millivolts but the pilot flame will not remain lit when the safety valve manual override is released, the gas control valve is judged faulty and should be replaced.

The test method described in the paragraph above tests the thermocouple under load conditions and tests the gas control system electrical circuit as a whole, but does not test the safety valve solenoid and ECO fuse portion of the electrical circuit. That is, a condition may exist where the ECO fuse is intact and the safety valve solenoid is operational, but the thermocouple device does not generate a millivolt current sufficient to energize the safety valve solenoid. In such case, according to the above test method, the recommendation is to replace the gas control valve when, in fact, the thermocouple device should be replaced with one having a higher millivolt output.

SUMMARY OF THE INVENTION

Now, according to the present invention, I have invented apparatus and a methods for testing operability of a safety valve solenoid and an ECO fuse of a fuel gas control system under electrical load conditions to determine whether the safety valve solenoid and ECO fuse, are functionally operable and for separately testing the millivolt output of a thermocouple device in the fuel gas control system.

The advantages of the apparatus and test methods of the present invention include the ability to determine whether the safety valve solenoid and ECO fuse are operable separately from the thermocouple device and whether the safety valve solenoid and thermocouple device are compatible for operating together as elements of a fuel gas control system. These and other advantages of the methods and apparatus of the present invention will be described in the Detailed description of the invention which follows.

DETAILED DESCRIPTION OF THE INVENTION

The detailed description of the invention which follows is made with reference to the drawings and in terms of a preferred embodiment of the invention. The detailed description is not intended to limit the scope of the present invention, and the only limitations intended are those embodied in the claims hereto.

Figure 1:
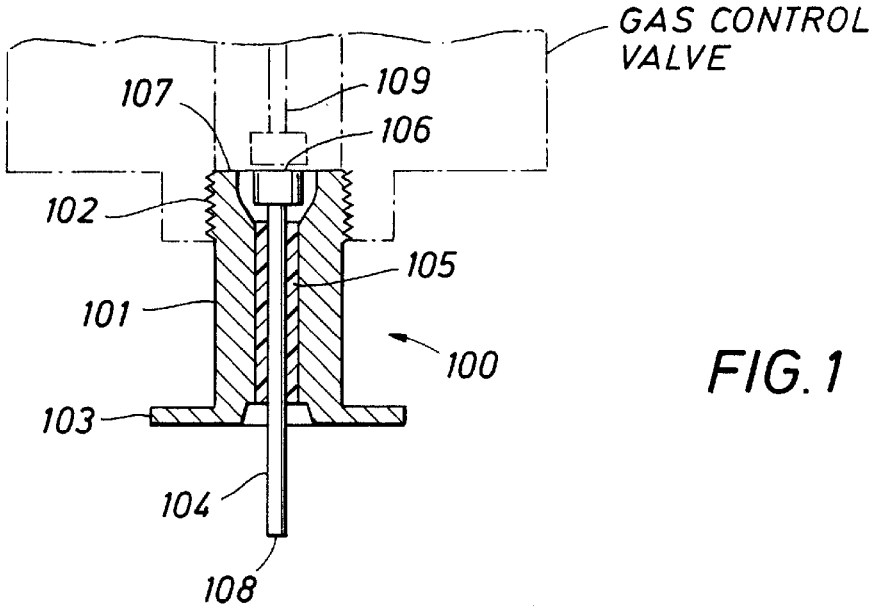
FIG. 1 of the drawings is a sectional view of the adaptor of the present invention, showing the adaptor connected to the thermocouple port of a gas control valve. (shown in ghost view)

According to the method of the present invention, the apparatus of the invention is used to: determine operability of a safety valve solenoid and an ECO fuse in an appliance fuel gas control system; determine operability of a thermocouple device in the fuel gas control system; and from these two determinations determine whether the safety valve solenoid and the thermocouple device are compatible for operation together in the fuel gas control system;

In FIG. 1, an adaptor 100 is shown in sectional view. Adaptor 100 is designed for connection to the thermocouple connection port of a gas control valve, as shown in ghost view in FIG. 1. Adaptor 10 comprises an electrically conductive, hollow tubular member 101 having threads 102 at a first end for threadingly engaging the thermocouple port of a gas control valve, and having a flange 103 at a second end for assisting in the manual engagement of the threads 12 in the gas control valve thermocouple port and for providing a connection for a ground wire of the test instrument, as will be described below. An electrically conductive cylindrical member 104 passes axially through tubular member 101 and is held in place and is electrically insulated from tubular member 101 by hollow cylindrical insulating member 105. A first end 106 of cylindrical member 104 extends axially to a position about even with the first end 107 of tubular member 101 for contacting an electrical input connection 109 for a safety valve solenoid and an ECO fuse, not shown. A second end 108 of cylindrical member 104 extends axially beyond flange 103 of tubular member 101.

For performing the tests of the safety valve solenoid and ECO fuse, according to the method of the present invention, a thermocouple device, not shown, is disengaged from the thermocouple port of the gas control valve and adaptor 100 is threadingly engaged in the gas control valve thermocouple port. Upon such engagement, cylindrical member 104 first end 106 contacts the voltage input side 109 of a safety valve solenoid-ECO fuse electrical circuit of the fuel gas control system and the threaded tubular member 101 contacts the ground side of the safety valve solenoid-ECO fuse electrical circuit. The protruding end 108 of cylindrical member 104 and the flange 103 of tubular member 101 provide means for connecting the test instrument of the present invention to the safety valve solenoid-ECO fuse circuit, as will be described below.

The test instrument of the present invention is an electronic instrument which, working in cooperation with adaptor 100, is employed in the method of the present invention for testing operability of the safety valve solenoid and ECO fuse of a fuel gas control system and is employed for testing operability of a thermocouple device of the fuel gas control system.

Figure 2B:
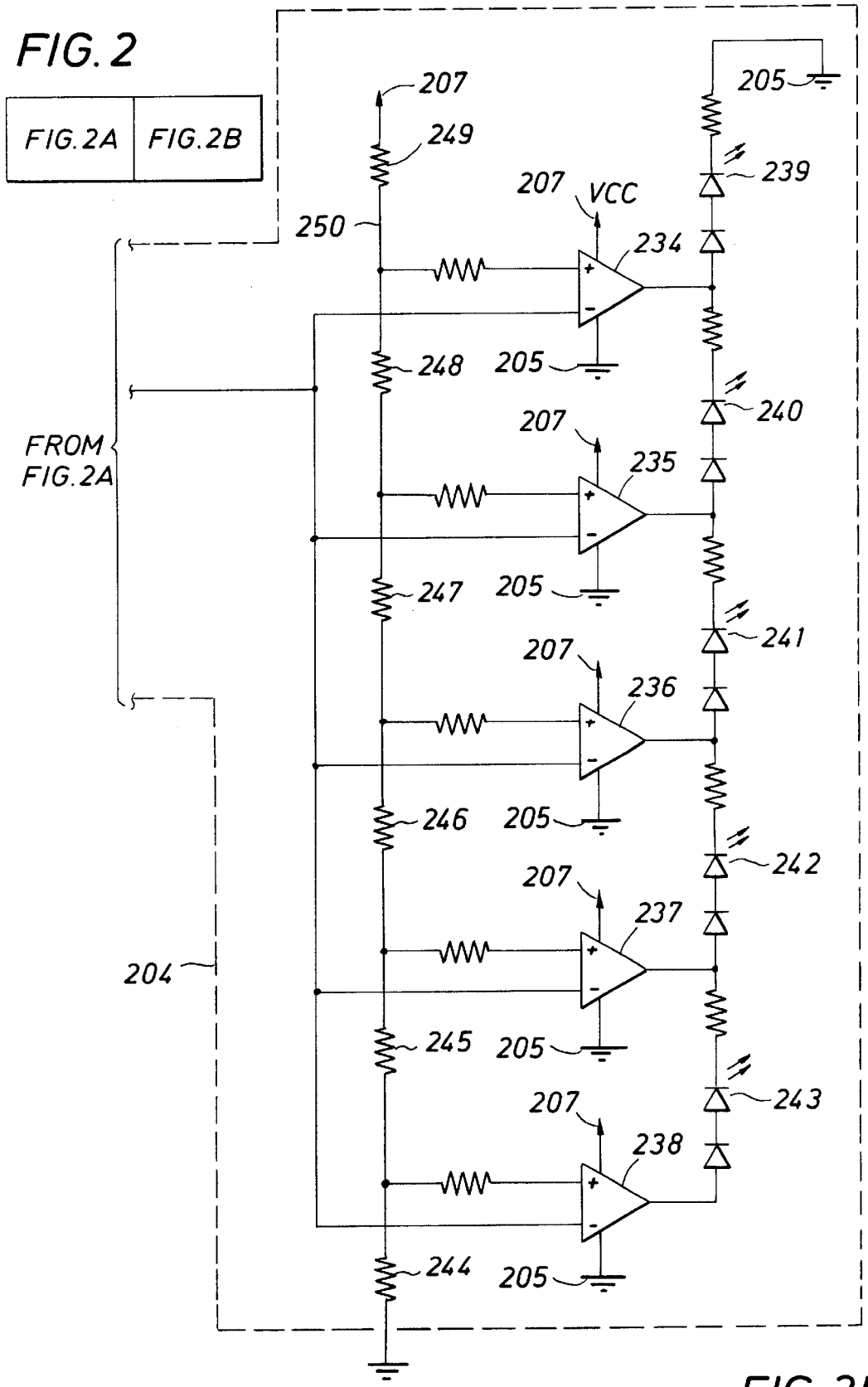
FIG. 2 of the drawings is a-preferred electrical schematic of the test instrument of the present invention.
Figure 2A:
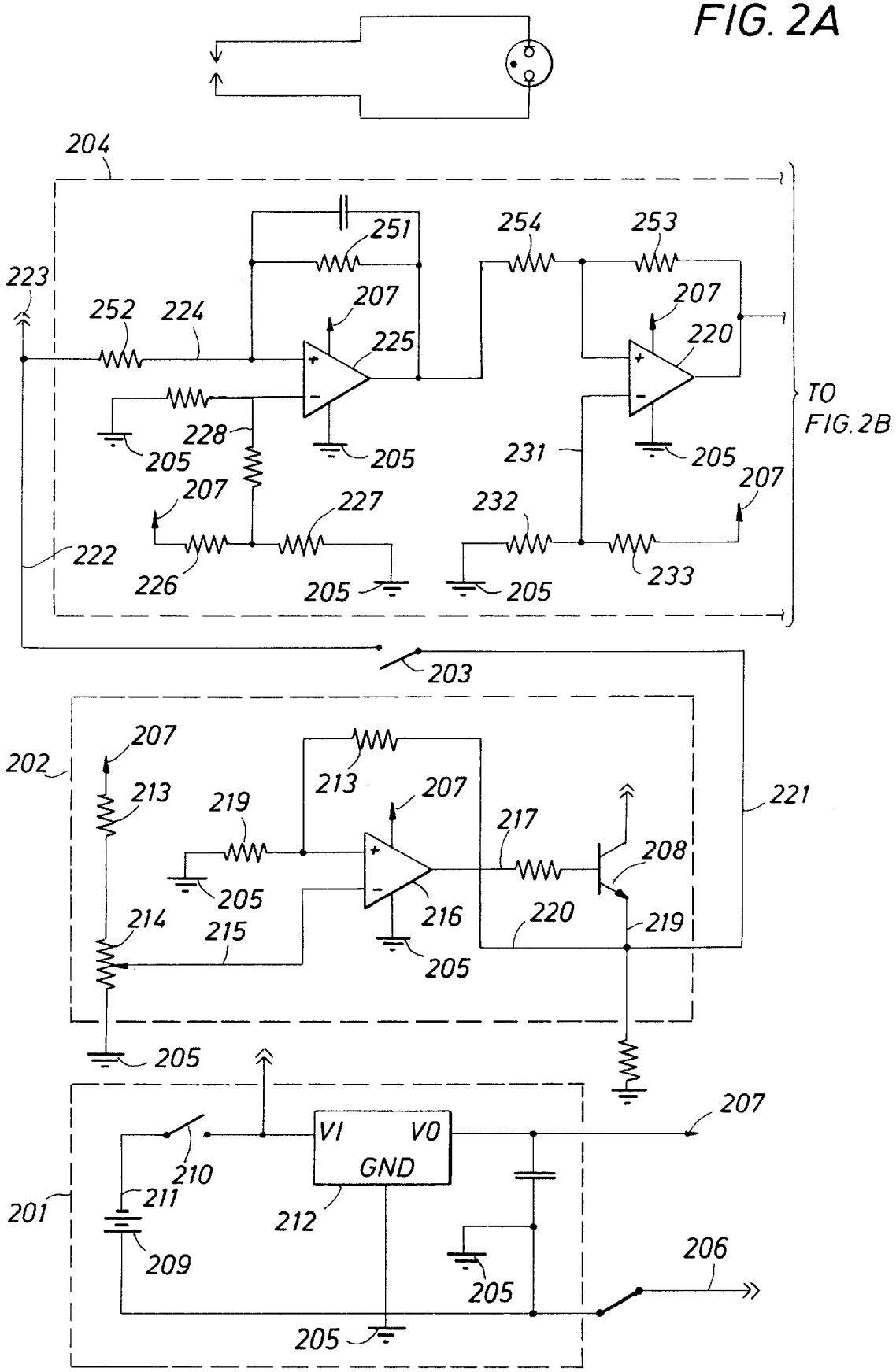

In FIG. 2, an electrical schematic of a preferred embodiment of the test instrument 200 is shown. Test instrument 200 comprises a voltage regulated power source 201, an adjustable DC millivolt current source 202, switching means 203 and millivolt display 204.

Test instrument 200 has first and second test modes. The first test mode is for testing millivolt output of a heated thermocouple device of an appliance fuel gas control system. The second test mode is for testing operability of a safety valve solenoid-ECO fuse circuit of an appliance fuel gas control system. Test instrument 200 is switched from first test mode to second test mode by closing switching means 203.

In FIG. 2, all electrical grounds 205 and external ground 206 are connected to provide a common electrical ground for test instrument 200.

In FIG. 2, Power source 201 provides a source of voltage regulated DC current via line 207 for operating other electronic components of test instrument 200. and provides unregulated DC current as required for operation of transistor 208 in adjustable millivolt DC current source 202. In a preferred embodiment, as shown in FIG. 2, power source 201 comprises a battery 209, preferably of 9 volts, having a positive pole electrically connected via switch 210 to voltage regulator 212. The negative pole 213 of battery 301 is connected to test instrument ground system 205. Unregulated DC current from battery 209 is converted to a voltage regulated DC current, preferably of 5 volts, at voltage regulated DC current line 207.

In FIG. 2, voltage regulated DC current is supplied, via line 207, to a voltage divider comprising resistor 213 and variable potentiometer 214. DC current is fed via line 215 into amplifier 216 wherein DC current is converted to a millivolt DC current at amplifier 216 output 217. The voltage range of the millivolt DC current at output 217 is varied by adjusting variable potentiometer 214. Amplifier 216 is an op-amp in an inverting configuration having a gain equal to 1 plus the ratio of the resistances of resistor 218 and resistor 219, (1+R218/R219). Preferably the gain of Amplifier 216 is 2. The millivolt DC current from amplifier 216 flows via line 217 into transistor 208. Transistor 208 is a switching transistor which limits the flow of the millivolt DC current to a safety valve solenoid-ECO fuse circuit to be tested according to the method of this invention. As the resistance of the safety valve solenoid is low, in the milli ohm range, it is desirable that the millivolt DC current have a rather high amperage, in the range of about 1 amp. The millivolt DC current flows from transistor 208 via line 219. A first portion of the millivolt DC current from line 219 flows via line 220 as feed back current to amplifier 216 and a second portion of millivolt current from line 219 flows, via line 221 for testing operability of a safety valve solenoid-ECO fuse circuit according to the second testing mode of the present invention.

In the second testing mode of the present invention, switch 203 is closed and millivolt DC current flows via line 221, through switch 203 and via line 222 to external connector 223. From external connector 223, millivolt DC current flows into a safety valve solenoid-ECO fuse circuit, as will be described below.

In FIG. 2, millivolt display means 204 is electrically connected to line 222 for providing a visual display of the voltage of a millivolt DC current carried by line 222. In the first test mode, with switch 203 open, line 222 carries a millivolt DC current from a heated thermocouple device, as will be described below. In the second test mode, with switch 203 closed, line 222 carries a millivolt DC current supplied from variable millivolt source 202.

Millivolt visual display 204 may comprise any convenient device which will accurately display the voltage of a millivolt DC current generated in the first test mode or the second test mode of test instrument 200 operation. Commonly, the millivolt DC currents generated will have voltages in the range of about 0 to 30 millivolts, and a visual display in the range of about 4 to 20 millivolts is adequate for millivolt visual display 204. Millivolt display 204 may comprise a digital millivolt meter, an analog millivolt meter, or, in a preferred embodiment, an LED display.

In FIG. 2, the preferred millivolt visual display 204 is an LED display. millivolt DC current from line 222 is fed via line 224 into a first stage amplifier 225. First stage amplifier 225 is an op-amp in differential, (inverting), configuration. Reference current from line 207 is fed to first stage amplifier 225 via line 228. resistance values of resistors 226 and 227 are selected to bias the first stage amplifier out put, at line 229, to 2.5 volts. First amplifier stage out put current from line 229 is fed into second stage amplifier 230. Second stage amplifier is also an op-amp amplifier in differential, (inverting ), configuration. A reference current is fed to second stage amplifier 230 via line 231. Voltage of the second stage reference current is established by selecting the resistance values of resistors 232 and 233. Preferably, the second stage reference current is 2 volts. With the output current of first stage amplifier at 2.5 volts and second stage reference current at 2 volts, the difference is 0.5 volts. Upon amplification of this difference by the second stage amplifier, the second stage amplifier output is at 1 volt, (2–0.5×2=1 volt).

In FIG. 2, output current from second stage amplifier 230 is fed into an electrical ladder comprising amplifiers 234, 235, 236, 237,and 238. These amplifiers are op-amps used as comparators to drive display LEDs 239, 240, 241, 242, and 243. Resistors 244, 245, 246, 247, 248 and 249 form a series of voltage dividers which provide the various voltage thresholds required by each comparator. When no voltage is applied from second stage amplifier 230, all the comparator amplifiers are at the ground power supply rail. Preferably, resistors 244, 245, 246, 247, 248, and 249 are selected such that amplifier comparators 238, 237, 236, 235, and 234 are serially activated to the regulated voltage rail 250 upon 4 millivolt increases in millivolt DC current fed into the first stage amplifier 225. That is, with base out put current of first stage amplifier 225 at 2.5 volts, and reference current to second stage amplifier 230 at 2 volts, the overall gain of the two amplifiers is set at 80 by selecting resistance values of resistors 251 and 252 for first stage amplifier 225 and of resistors 253 and 254 for second stage amplifier 230. At an overall gain of 80, the output of second stage amplifier 230 increases 80 millivolts for each millivolt of input into first stage amplifier 225. For example, when input current to first stage amplifier 225 is 4 millivolts, out put current from second stage amplifier 230 is 1.32 volts, (1+4×80). With amplifier comparators 238, 237, 236, 235, and 234 circuits set to serially activate the amplifiers upon each 4 millivolt increase in current input into first stage amplifier 225, the 1.32 volt output from second stage amplifier 230 will cause output of amplifier comparator to change from the ground rail to the regulated voltage rail 250. As amplifier comparator 237 remains at the ground rail, current flows from the output of amplifier 238 through LED 243, causing LED 243 to light. As the voltage from second stage amplifier 230 increases, each comparator amplifier 237, 236, 235, and 234 will switch to the regulated voltage rail upon each increase of 320 millivolts, causing each LED 242, 241, 240, and 239 to light in succession, turning off the LED behind it.

Figure 3:
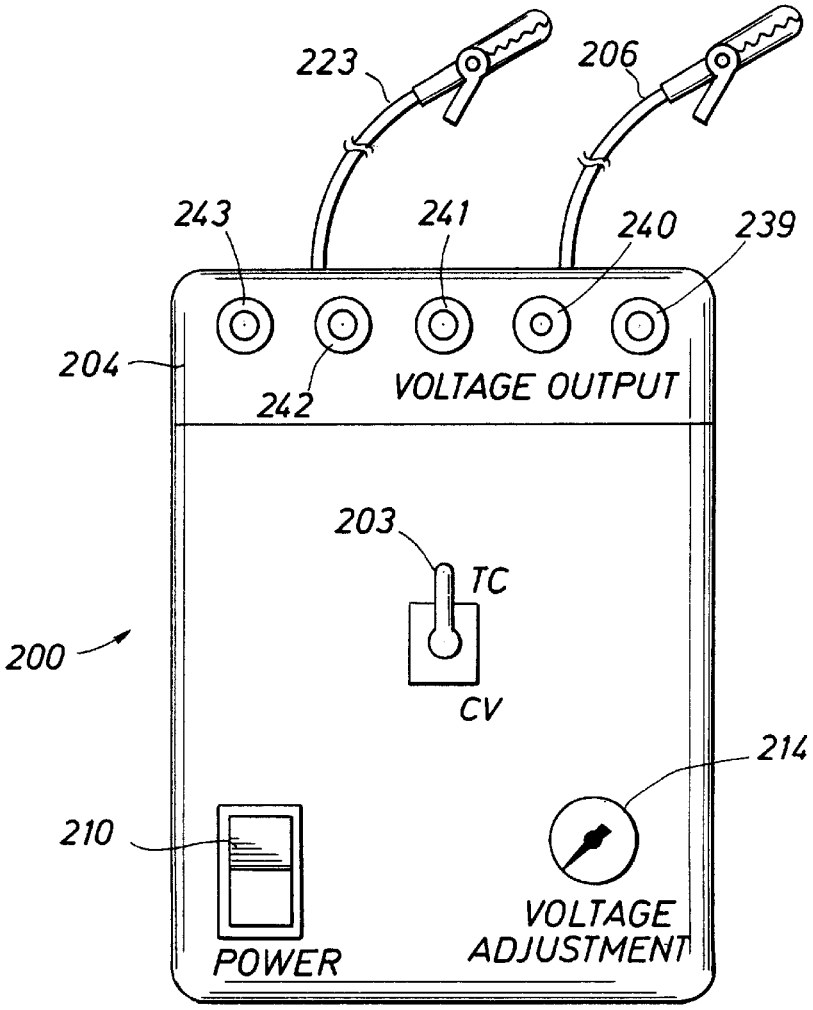
FIG. 3 of the drawings is a plan view of the test instrument of the present invention, showing external electrical connectors, manual adjustment means and a millivolt voltage visual display.

In FIG. 3, the exterior of test instrument 200, with manual instrument controls and millivolt visual display elements, is shown. The electrical circuitry of test instrument 200 is shown if FIG. 2, and is described above. Test instrument 200 has two modes of operation, In the first mode of operation, test instrument 200 is employed to test operability of a thermocouple device employed in a fuel gas control system for a gas fired appliance. In a second mode of operation, test instrument 200 is employed for testing operability of a safety valve solenoid-ECO fuse circuit of a fuel gas control system for a gas fired appliance. Test instrument 200, in this embodiment, is battery powered. Battery power is switched on or off by power switch 210. Operation of test instrument 200 will be given with reference to FIG. 1, 2 and 3 of the drawings.

In the first mode of operation, test instrument 200 is employed to test operation of an appliance fuel gas control system thermocouple device. In this first mode of operation, the millivolt output from adjustable millivolt source 202 is not required. However, electrical power from constant voltage source 201 is required for operation of the LED visual millivolt display. Switch 210 is closed for generating a constant voltage current for operation of the LED displays of millivolt display 204. Switch 203 is placed in the open position to prevent the millivolt current from adjustable millivolt source 202 from interfering with the first mode test of a thermocouple device.

For the first mode test, a thermocouple device is disconnected from the thermocouple port of a fuel gas valve in a fuel gas control system. Test instrument external connector 206 is connected to the copper tube first electrical conductor of the thermocouple device and external connector 204 is connected to the thermocouple second electrical conductor. The gas control valve manual shunt is placed in "pilot" position and the manual override is depressed for allowing fuel gas to enter the pilot flame device. A pilot flame is ignited and the manual override is held in the depressed position for maintaining the pilot flame. millivolt visual display 204 is observed for a period of about 3 minutes. If LED 241 lights, representing 12 millivolts output from the thermocouple device, the thermocouple device is judged operational and the test may be discontinued. If LED 243 or 242 light, but LED 241 does not light, the thermocouple device is judged questionable and may need to be replaced. If none of the LEDs light, the thermocouple device is defective and must be replaced. In all cases, care must be taken to ensure that good electrical contact is maintained between the connectors 223 and 206 and the thermocouple device. Also, care should be taken to see that the thermocouple device is properly placed in relation to the pilot flame to ensure that the thermocouple is properly heated.

In the second test mode, adaptor 100 and test instrument 200 are employed to test the safety solenoid valve-ECO fuse circuit of a fuel gas supply system. For the second mode test, a thermocouple device is disconnected from a thermocouple port of a gas control valve in a fuel gas control system. Adaptor 100 is connected to the gas control valve at the thermocouple port. External connector 223 of test instrument 200 is connected to cylindrical member 104 of adaptor 100, and external connector 206 is connected to flange 103 of adaptor 100. Test instrument variable potentiometer is turned counter clockwise to its lowest setting, power switch 210 is closed and switch 203 is closed. The gas control valve manual shunt is placed in "pilot" position, the manual override is depressed and the pilot flame is lit. the manual override is kept depressed to maintain the pilot flame. Variable potentiometer 214 is turned clockwise until LED 241 lights, representing 12 millivolts DC current applied to the safety valve solenoid-ECO fuse circuit of the fuel gas control system. Then, the manual override is released and an observation whether the pilot flame remains lit is made. If the pilot flame remains lit, the safety valve solenoid-ECO fuse circuit is judged to be operable. The test may be continued by turning the variable potentiometer counter clock wise until LED 241 goes out and LED 242 is lit. Observation is made to determine whether the pilot flame remains lit. If the pilot flame remains lit when LED 242 is lit, the safety valve solenoid is judged in good condition and should be operable with a thermocouple device which is in good condition. If the pilot flame does not remain lit when LED 241 is lit, the test is repeated with the variable potentiometer being rotated clockwise until LED 240 lights, representing 16 millivolt DC current applied to the safety valve-ECO fuse circuit. If the pilot flame remains lit when LED 240 is lit but does not remain lit when LED 241 is lit, the safety valve solenoid-ECO fuse circuit is judged operable, but care must be taken to select a thermocouple device having sufficient millivolt out put to activate the safety valve solenoid. If the pilot flame does not remain lit when LED 240 or LED 239 are lit, the safety valve solenoid-ECO fuse circuit is judged faulty and the gas control valve must be replaced.

While the present invention has been described with reference to preferred embodiment, the same are to be considered illustrative only and not limiting in character, and that many modifications to the methods and apparatus of the present invention will occur to those skilled in the art without departing from the spirit and scope of the invention, which is defined only by the appended claims.

I claim and wish to protect by Letters Patent:

1. Apparatus for testing electrical components in a fuel gas control system for a gas fired appliance, comprising:

A. an adaptor comprising:

1. an electrically conducting tubular member, having a tubular member first end adapted for connection to a thermocouple port of a fuel gas control valve of the fuel gas control system, and having a tubular member flanged second end located outside the thermocouple port;
2. an electrically conducting cylindrical member extending axially through the tubular member, having a cylindrical member first end adjacent the tubular member first end and having a cylindrical member second end extending axially beyond the tubular member second end;
3. an electrically insulating member engaged with the tubular member and the cylindrical member for maintaining the cylindrical member in position within the tubular member and for electrically insulating the tubular member from the cylindrical member; and B. a test instrument comprising:

1. first means, for generating a voltage regulated DC current from an unregulated DC current, having a voltage regulated DC current out put connection and having at least one electrical ground connected to a test instrument electrical ground;
2. second means electrically connected to the first means voltage regulated DC current out put connection, for generating an adjustable millivolt DC current from the voltage regulated DC current, having a manually adjustable variable potentiometer for adjusting the voltage of the adjustable millivolt DC current, having an adjustable millivolt DC current output connection and having at least one electrical ground connected to the test instrument electrical ground;
3. third means, for connecting the adjustable millivolt DC current output connection from the second means to the adaptor cylindrical member second end;
4. fourth means, for electrically connecting the test instrument electrical ground to the adaptor tubular member second end; and
5. a millivolt visual display means electrically connected to the third means for visually displaying the voltage of the adjustable millivolt DC current passing from the second means, through the third means to the adaptor cylindrical member second end.

2. The apparatus of claim 1, including:

a second switch means electrically connected between the test instrument second means adjustable millivolt DC current output connection and the test instrument third means for connecting and disconnecting the test instrument third means and the millivolt visual display to and from the adjustable millivolt DC current output connection.

3. The apparatus of claim 2, including, the test instrument first means comprising:

a battery, for providing unregulated DC current, having a positive pole and having a negative pole connected to the test instrument electrical ground;

a voltage regulator, for converting the unregulated DC current to voltage regulated DC current, having an unregulated DC current input connection and having the voltage regulated DC current output connection; and first switch means electrically connected between the battery positive pole and the voltage regulator unregulated DC current input connection, for connecting and disconnecting the voltage regulator to and from the battery positive pole.

4. The test instrument of claim 3, including; the test instrument second means comprising:

a first amplifier stage, comprising a first amplifier, in non-inverting configuration, having an input connection and having an output connection electrically connected to a transistor, for converting the voltage regulated DC current from the test instrument first means voltage regulated DC current output connection into the adjustable millivolt DC current;

the transistor having an adjustable millivolt DC current output connection;

the manually adjustable variable potentiometer electrically connected between the test instrument voltage regulated DC current output connection and the first amplifier input connection, for manually adjusting the voltage of the adjustable millivolt DC current to a selected value.

5. The apparatus of claim 1, including:

the test instrument millivolt visual display means comprising a millivolt display selected from the group consisting of a digital millivolt meter, an analog millivolt meter, and an LED millivolt display.

6. The apparatus of claim 5, wherein the LED millivolt display comprises:

second and third amplifier stages, both in differential configuration, electrically connected in series for amplifying the voltage of a millivolt DC current from the test instrument third stage and producing a voltage amplified DC current at a third amplifier stage output;

a plurality of amplifier comparators electrically connected to the third amplifier stage output and electrically connected to the voltage regulated DC current output connection of the test instrument first means;

a plurality of LED devices, each connected to one of the amplifier comparators such that the LED devices light in serial order as the voltage of the third amplifier stage voltage amplified DC current output increases.

* * * * *